US006722505B2

(12) United States Patent
Kobayashi

(10) Patent No.: US 6,722,505 B2
(45) Date of Patent: Apr. 20, 2004

(54) ROTARY ADJUSTABLE DIRT/SAND/ROCK SEPARATOR

(76) Inventor: Herbert S. Kobayashi, 1428 FM 528 W., Webster, TX (US) 77598-4702

( * ) Notice: Subject to any disclaimer, the term of this patent is extended or adjusted under 35 U.S.C. 154(b) by 191 days.

(21) Appl. No.: 10/062,025

(22) Filed: Jan. 31, 2002

(65) Prior Publication Data

US 2003/0141191 A1 Jul. 31, 2003

(51) Int. Cl.[7] ..... B07B 1/49; E02F 3/04; E02F 3/64

(52) U.S. Cl. ..... 209/421; 209/235; 209/676; 209/931; 37/411; 37/431; 37/901

(58) Field of Search ..... 209/420, 421, 209/235, 676; 37/411, 431, 433, 427, 426, 414, 415, 901

(56) References Cited

U.S. PATENT DOCUMENTS 3,395,798 A * 8/1968 Erickson ..... 209/260
4,157,956 A * 6/1979 Robinson ..... 209/260
4,864,748 A * 9/1989 Boyer ..... 37/142.5
5,379,534 A * 1/1995 Negishi ..... 37/379
5,619,811 A * 4/1997 Yrjola ..... 37/466
5,887,810 A * 3/1999 Maruyama ..... 241/189.1
6,237,257 B1 * 5/2001 Cronk, Jr. ..... 37/142.5
6,375,012 B1 * 4/2002 Leyland et al. ..... 209/421
6,499,681 B1 * 12/2002 Maruyama ..... 241/74

* cited by examiner

*Primary Examiner*—Donald P. Walsh
*Assistant Examiner*—Jonathan R. Miller

(57) ABSTRACT

Aggregate mixtures such as dirt, sand, rock, concrete, etc. are separated into piles according to size by continuous agitation of the mixture and by gravitational and centrifugal forces exerted thereon. A container for the material, such as the bucket of a backhoe, has the bottom thereof at least partially open. An adjustable, hydraulically-driven rotating disk attaches to and covers the open portion of the bottom of the container, the combination having a gap, or a selected spaced-apart relationship, between the stationary container and the rotating disk. The mixture is agitated by the rotating disk and by contact with the other particles in the container. Particles smaller than the selected gap distance are thrown out through the gap between the disk and the open portion of the container by centrifugal force. Material larger than the selected gap size remains in the container.

9 Claims, 5 Drawing Sheets

ROTARY ADJUSTABLE DIRT/SAND/ROCK SEPARATOR

BACKGROUND OF THE INVENTION

1. Field of the Invention

The preferred embodiment of the invention is directed to self-loading rock and aggregate separators using a combination of gravity, agitation and centrifugal force for separation. The apparatus acquires a load of aggregate (a mixture of various materials such as sand, gravel, rock, etc.), makes selected piles of different size particles and dumps the remaining mixture in still another pile. The apparatus is adjustable for successively separating a selected size particle, e.g., less than one inch, one inch, three inches, twelve inches, etc. Separation of the different materials is obtained by agitation and by forcing particles out between relatively moving portions of the apparatus by means of centrifugal forces and gravity.

2. Description of Related Art

Prior art devices include a rake or fork separator attached to a backhoe or a bulldozer. These devices do not produce piles of different size particles and do not do a good job of separating particles because the smaller particles usually are not separated from the larger particles. In these devices, separation is dependent upon gravity alone and not by the use of vibration, agitation or centrifugal forces.

Another type of separator, known as a Grizzly separator, consists of slanted rails in which small particles fall between the rails. Large particles that cannot pass between the rails, roll off by the force of gravity. This device is also not adjustable and depends solely upon gravity, and does not achieve separation by vibration, agitation or centrifugal forces. This separator is heavy and does not do a good job of separating the mixture. Usually the separation of particles is in two groups, that is, the particles that fall between the rails and the particles that roll off the rails.

Still another type of separator, known as a rotary drum screen separator, requires a feeder. The mixture is rotated inside the drum where the mixture is screened for the smaller particles first. The slant of the drum enables larger particles to be screened at the end of the drum. The remaining large particles are then discharged. This device requires a feeder and the system is very heavy, weighing between 10–50 tons.

Another prior art device comprises a vibrating screen separator which separates the particles by different size screens arranged in multiple layers. Particles smaller than the screen size fall through the screen and onto the next size screen while particles that are too large to pass through the screen are vibrated off the screen. This device may require a feeder, requires a lot of power to run and weighs between 5–10 tons. Wet materials may cause problems in the separation process.

SUMMARY OF THE INVENTION

The purpose of the instant invention is to separate dirt and sand from rock or concrete that are mixed together, i.e., the separation of an aggregate mixture into piles according to a selected maximum size of the individual components of the aggregate. The piles may be separately placed on the ground or may be individually and sequentially placed on a conveyor belt. Plastic and like material may also be separated from dirt and sand according to size. The instant invention enables better separation of a mixture because agitation of the material is continuous, and may be repeated over and over again separating the mixture by agitation, gravity and centrifugal forces, and does not depend on a one-pass gravity procedure as in the prior art. The material to be separated is thrown out by centrifugal force from between a gap formed between a rotating disk and a stationary portion of a machine such as the bucket of a backhoe. A portion of the bottom of the bucket is removed and the rotating disk covers the cutout with a space therebetween. Required power is less since the mixture is not crushed and does not require a feeder. Wet materials may also be separated. After separation, the large particles may be used by placing them on a sand or clay bed to form a base, such as for a road bed. Once the base for the road is laid down, the smaller particles may be placed on top so that the top surface can be made smooth. The invention can be attached to a track or rubber-tired vehicle such as a front loader, farm tractor or other such equipment. The invention may also be used in a fixed installation or in conjunction with an overhead crane.

For purposes of illustrating the invention, a backhoe having a bucket with the bottom cut out may be utilized. An adjustable hydraulically-driven rotating disk attaches to the bucket and covers the cut out portion of the bottom of the bucket, the combination having a gap, or a selected spaced-apart relationship, between the stationary bucket and the rotating disk. The disk is driven by a combination hydraulic motor/transmission system the latter being well known in the art. It will also be appreciated that the disk may be mechanically driven. In the preferred embodiment, the bucket is self-loading and may be tilted back while the disk is rotating, thereby causing the mixture to be agitated by the disk and with the other particles in the bucket. Particles smaller than the selected gap distance, e.g., one inch in diameter, are thrown out, through the gap between the edge of the disk and the cutout portion of the bucket, by centrifugal force. After the particles of selected size have been separated into a pile, the gap may be increased and the bucket re-positioned so as to pile the next larger size particles of, say, one to three inches, etc. in a separate pile by repeating the process. This process is repeated until the gap has been increased to its maximum size. The pieces of rock or material larger than the selected size of the gap remain in the bucket and may be dumped out in still another pile by tilting the bucket and throwing the larger particles out of the bucket. Then, the process may be repeated by reloading the bucket with another load of a mixture, with the sand and dirt therein being separated to their respective piles as described above. Sometimes the disk may stall, due to wet material or particles hanging up in the gap, so the hydraulic motor/transmission system can be reversed to free the disk. This separator is not a rock crusher like a cone crusher.

DESCRIPTION OF THE PREFERRED EMBODIMENTS

Figure 1:
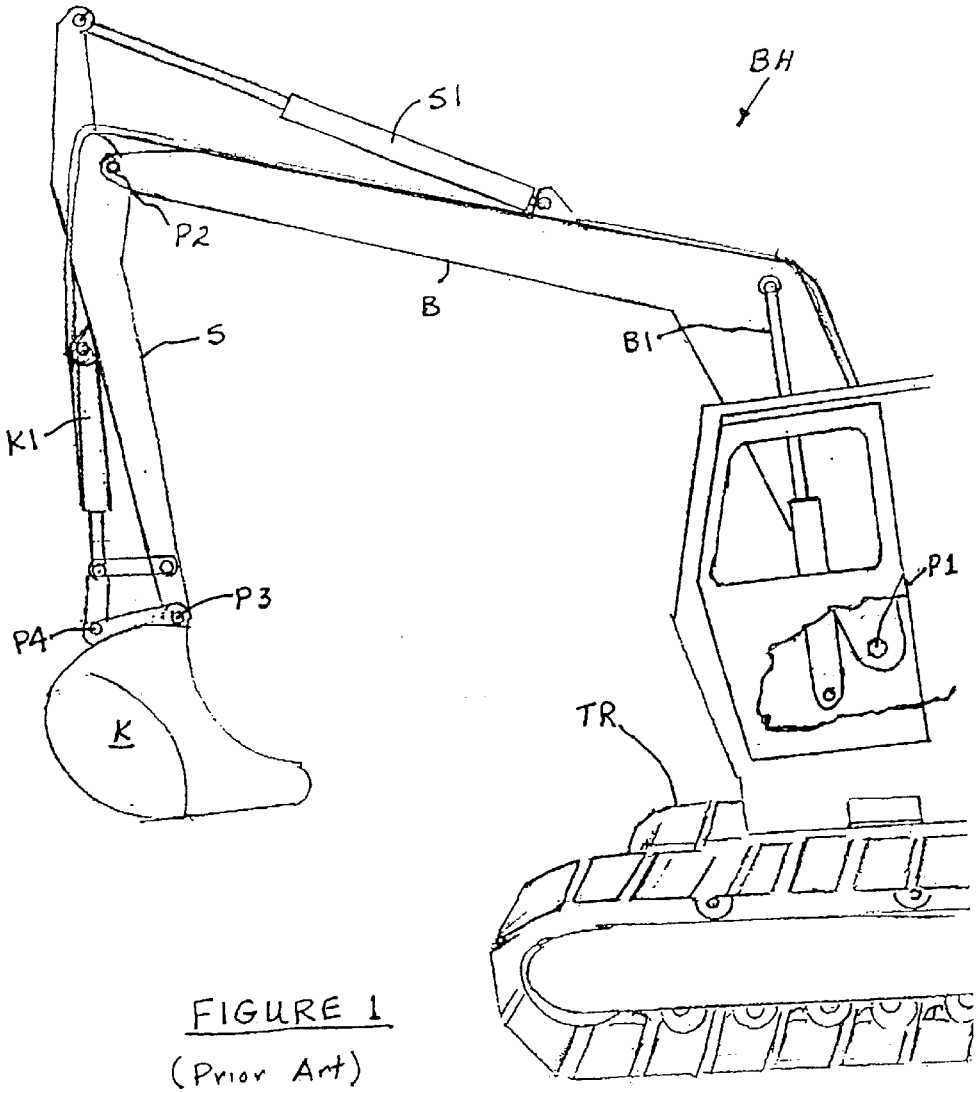
FIGURE 1 (Prior Art)
FIG. 1 is a drawing of a prior art backhoe machine which may be modified to accommodate the instant invention.

Referring now to FIG. 1 for purposes of illustration, a known machine such as a backhoe BH is shown which may be modified for use in the invention. As will be subsequently described below, the invention may also be used in a fixed position. The backhoe BH comprises a tractor TR having a boom B movably attached thereto, the boom B capable of being rotated around pin P1 by means of the hydraulic actuator(s) B1 so as to raise and lower the boom B. A member called a "stick" S is movably attached to the boom B at pin P2 and is rotated forward and backward (relative to the tractor TR) around pin P2 by hydraulic actuator S1. Movably attached to stick S by means of pin P3 is a bucket K which rotates (up and down relative to stick S) around pin P3 as hydraulic actuator K1 lifts and lowers the back of the bucket K by acting on pin P4. The tractor TR, boom B, stick S and bucket K are horizontally rotatable 360° as a common unit as is well known in the art and as described above.

Figure 2A:
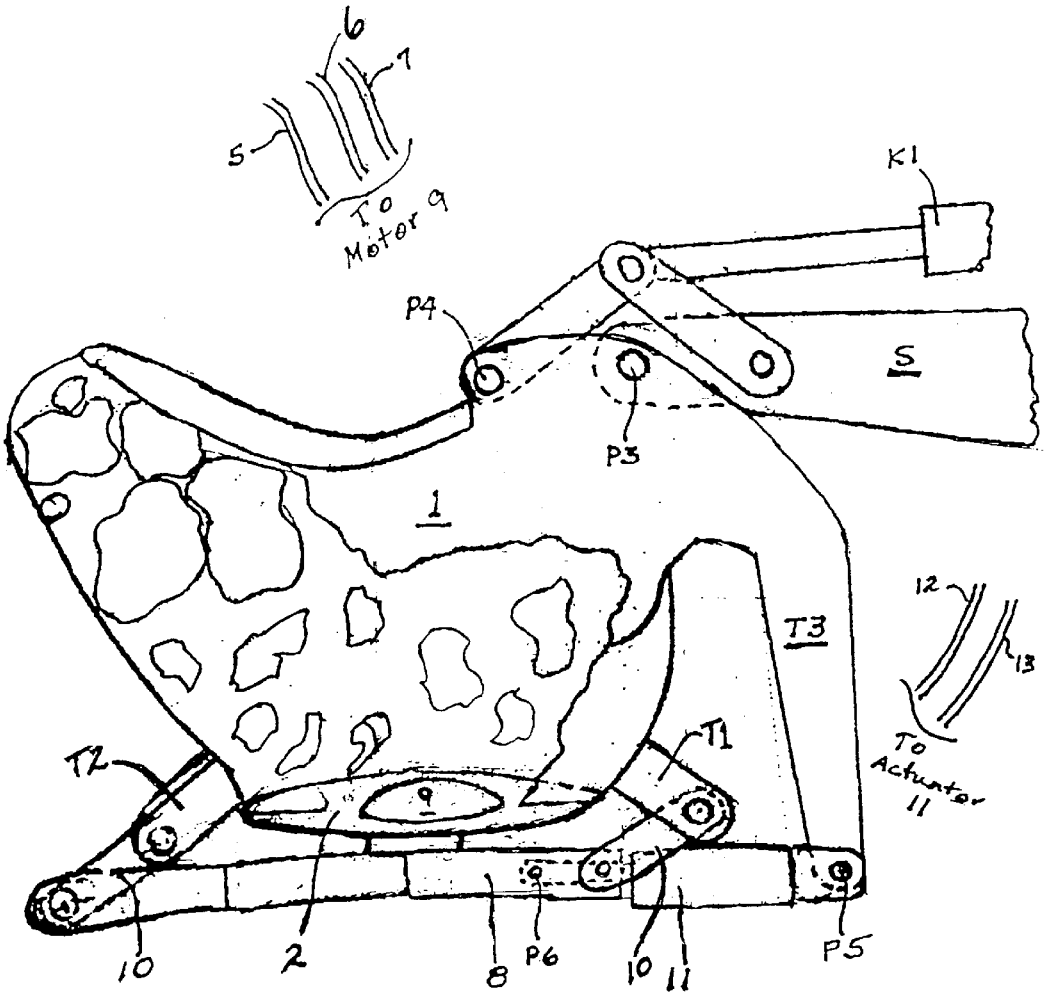
FIG. 2A is a cut-away drawing of the invention attached to a backhoe and showing the invention in its minimum gap mode.
Figure 2B:
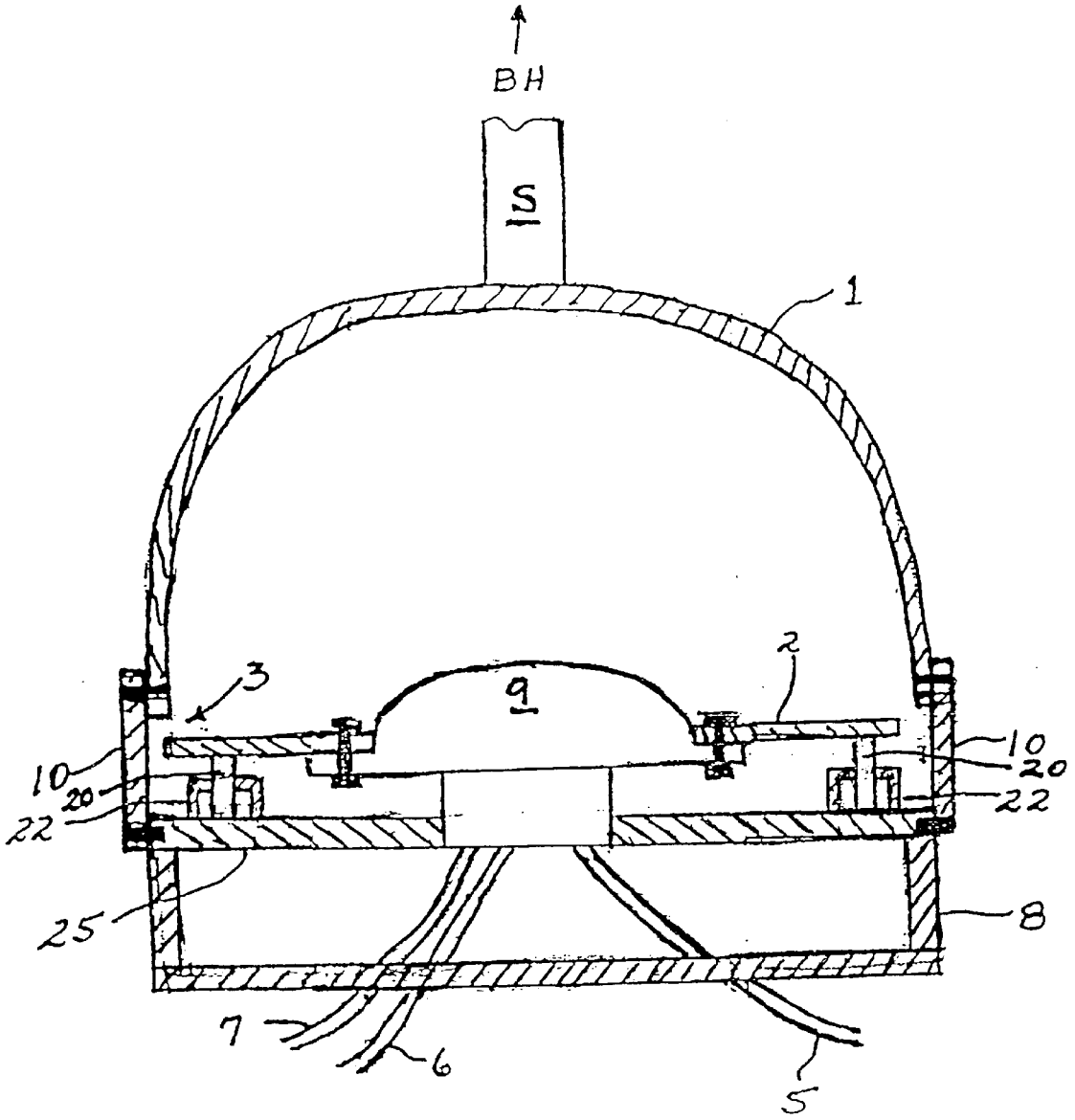
FIG. 2B is a cross sectional drawing of the invention shown in FIG. 2A.
Figure 3:
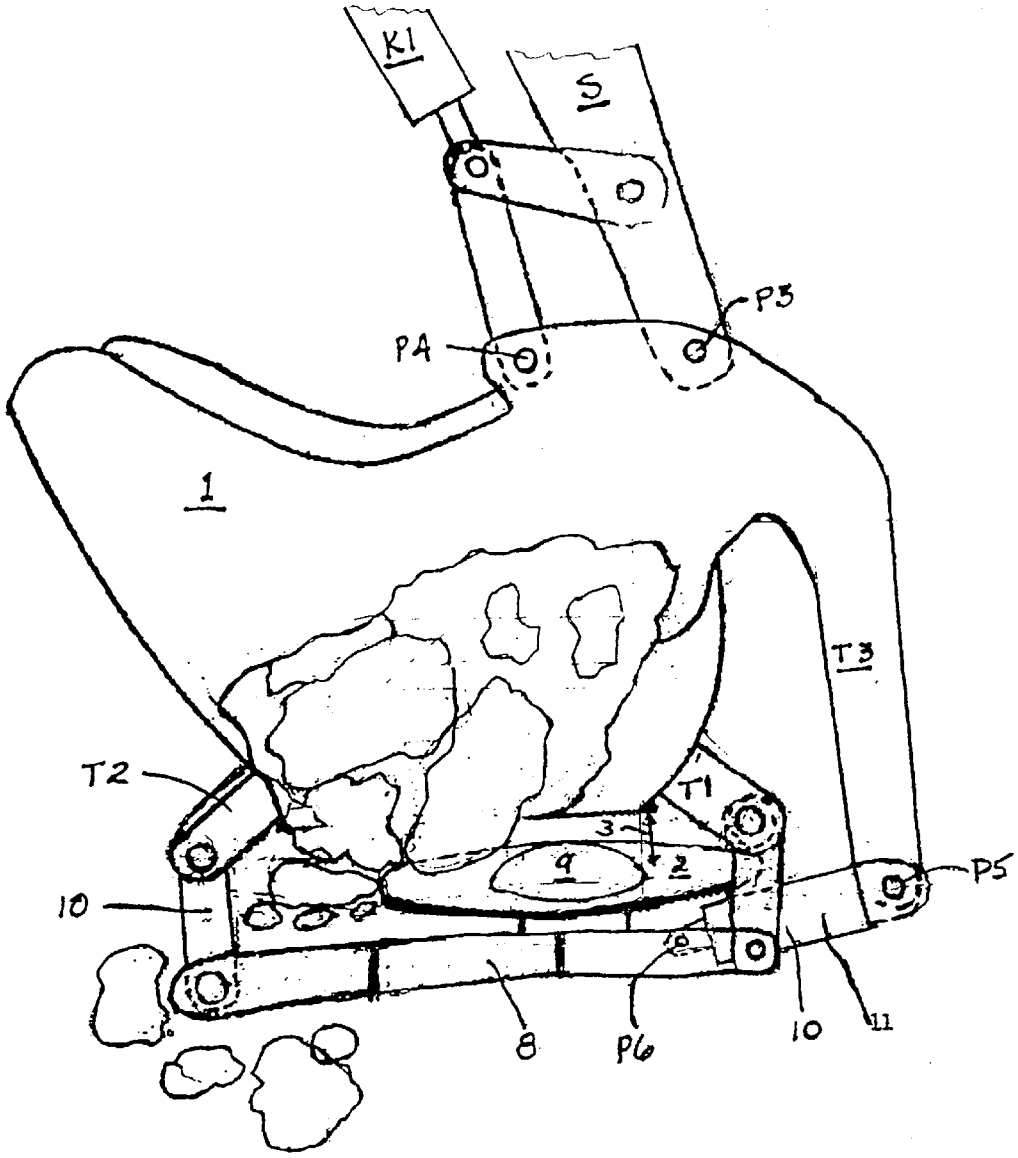
FIG. 3 is a drawing of the rotating disk movably mounted on the bucket of a backhoe showing the invention in its maximum gap mode.

Referring now to FIG. 2A, the bucket K of FIG. 1 has been replaced by a bucket 1 shown in a cut-away view with part of the bottom cut out. Pins P3 and P4 and actuator K1 are shown as they relate and correspond to those elements in FIG. 1. Also, since stick S is always in a near-vertical or upright position, the bucket K is shown in FIG. 2A in its "dumping" mode, i.e., after all the material has been separated except for the largest particles. The bucket 1 has been turned around 180 degrees with respect to the bucket K of FIG. 1. It will be appreciated that the bucket 1may be operated in either position. A rotating disk 2, shown more clearly in FIGS. 2B and 3, is rotatably mounted so as to rotate relative to the bucket 1 by means of the hydraulic motor/transmission 9 also shown more clearly in FIG. 2A. The disk 2 in the illustrative example may be, e.g., approximately forty inches in diameter but may be larger or smaller depending upon the size of the bucket 1. The hydraulic motor/transmission 9 is fixedly attached to a frame assembly 8, the latter being hingedly attached to bucket 1 as will be subsequently described. A variable gap 3 of, e.g., about one inch to about twelve inches may be selected and is located between the disk 2 and the bottom of the bucket 1 as shown more clearly in FIG. 2B. The hydraulic motor/transmission 9 is fixedly attached to, and supported by, a box frame 8, the entire assembly 8 being movably attached to bucket 1 by means of support trusses T1, T2, etc. and hinges 10 as will be described. The hydraulic motor/transmission 9/frame assembly 8 is hinged at, say, four points by hinges 10 movably pinned to the trusses T1, T2 (which are fixedly attached to the bucket 1 as by welding, riveting, bolts, etc.) and to the frame assembly 8 such that the gap 3 (see FIG. 2B) may be adjusted by a hydraulic actuator 11, the action of which is shown more clearly in FIGS. 4 and 5. Hydraulic hoses 6 and 7 provide hydraulic power for rotating the hydraulic motor/transmission 9 either clockwise or counterclockwise as desired for rotation of the disk 2. Return or leakage hose 5 provides a path for removal of fluid leakage inside the hydraulic motor/transmission 9. Hydraulic actuator 11, powered by hydraulic hoses 12, 13 is movably attached to bucket 1 by truss T3 (also fixedly attached to bucket 1) at pin P5. The movable shaft of actuator 11 is attached to frame 8 by pin P6 and is shown fully extended in FIG. 2A to produce a minimum gap 3. Thus, frame assembly 8 (with hydraulic motor/transmission 9 /disk 2 attached) may be moved relative to the cut out bottom of bucket 1 so as to adjust the gap 3 therebetween, the hinges 10 "swinging" frame assembly 8 and disk 2 attached thereto toward or away from the bottom of bucket 1. The length of the hinges 10 determines the maximum dimension of gap 3. It will be appreciated that, during all of the herein described operations, stick S is in a near-vertical or upright position.

FIG. 2B is a cross sectional view of the bucket 1 and disk 2 assembly. The disk 2 is rotatably mounted, via hydraulic motor/transmission 9, on a frame assembly 8 which, in turn, is movably (swivelably) mounted to the bucket 1 by means of the hinges 10. For ease of illustration, the trusses T1, T2, etc. are not shown. The disk 2 is attached by a drive shaft (not shown) to hydraulic motor/transmission 9 which is fixedly attached to frame 8 and provides power for rotating the disk 2 relative to the bucket 1. As the disk 2 rotates, it is supported by rollers 20 rotatably attached to plate 25 of frame 8 by means of fixed brackets 22

FIG. 3 shows the bucket 1 in position for normal operation, i.e., for separation of materials. Rotating disk 2 is positioned beneath the cut out portion of bucket 1 with the disk 2 extended by actuator 11 and hinges 10 to its maximum gap 3. Hydraulic motor/transmission 9 is connected to the disk 2 by a drive shaft (not shown) so as to selectively rotate the disk 2 either clockwise or counterclockwise as desired by the operation. The rotating disk 2 is controlled by an additional control valve in the backhoe tractor (not shown) which controls the flow of hydraulic fluid through hoses 6 and 7 as described above. The hinges 10 are shown fully extended for maximum spacing, e.g., say about twelve inches, between the rotating disk 2 and the bottom of the bucket 1. Thus, all particles twelve inches and smaller will be thrown out through the gap 3 between the bucket 1 and the disk 2. Particles larger than twelve inches will remain in the bucket for dumping as previously described. For maximum gap 3, actuator 11 is fully retracted as shown more clearly in FIG. 5.

Figure 4:
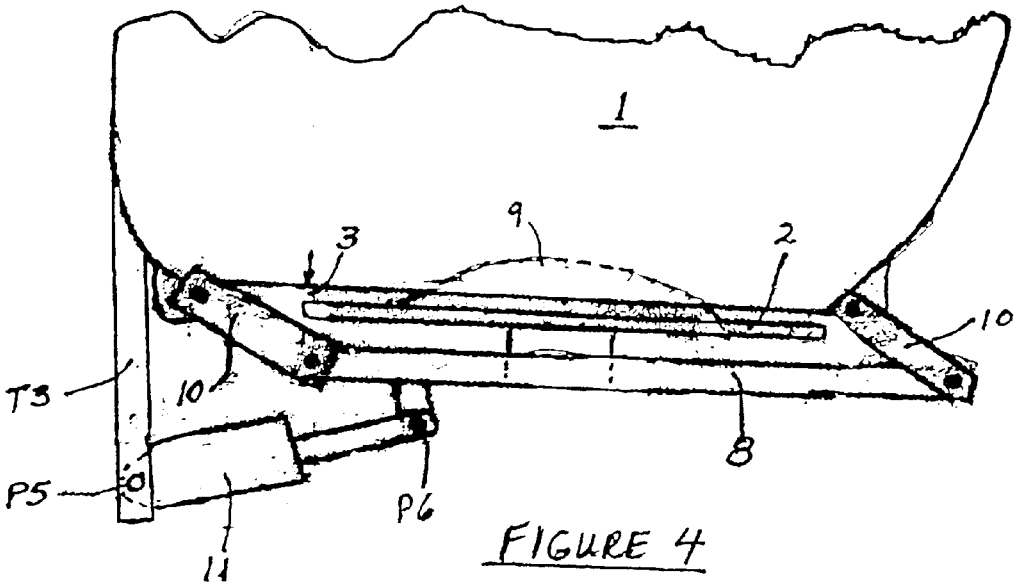
FIG. 4 is a drawing of the mechanism for adjusting the gap by means of a hydraulic actuator, the gap being at its minimum.
Figure 5:
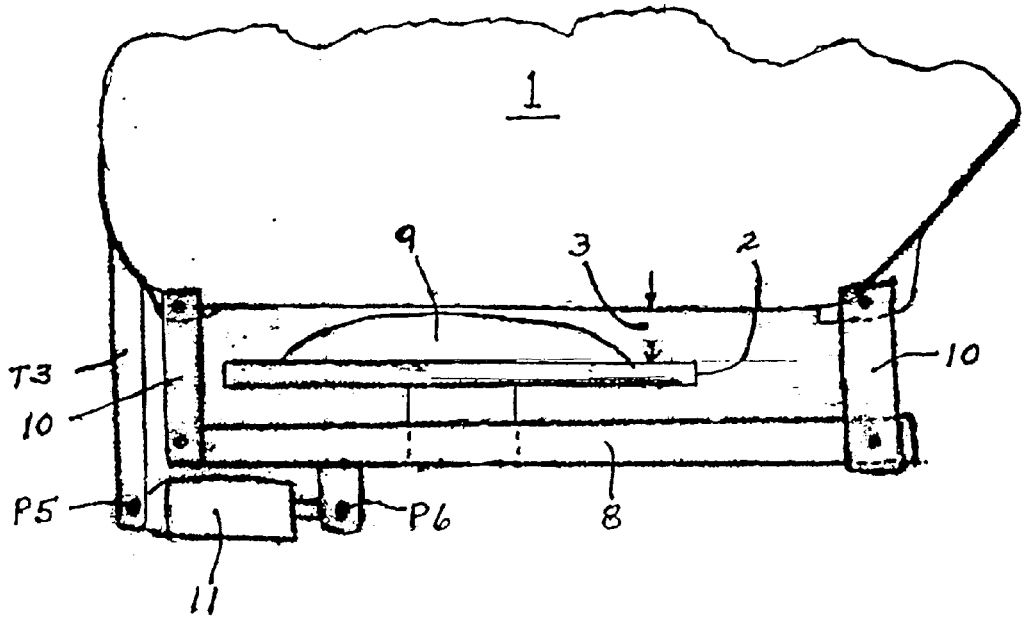
FIG. 5 shows another view of the invention with the mechanism at its maximum gap.

FIGS. 4 and 5 show, in more detail, the mechanism for adjusting the gap between the rotating disk 2 and the cutout portion of bucket 1. FIG. 4 shows the invention at the minimum gap 3 (actuator 11 fully extended) and FIG. 5 shows the invention at the maximum gap 3 (actuator 11 fully retracted). The gap 3 is decreased or increased by extending or retracting, respectively, the hydraulic cylinder 11 as shown in FIGS. 4 and 5 by means of hydraulic hoses 12 and 13 (see FIG. 2A). Cylinder 11 is controlled by an additional valve (not shown) on the tractor TR which valve controls the flow of hydraulic fluid through hydraulic hoses 12 and 13 to and from the cylinder 11. The backhoe BH is normally powered by a motor that drives multiple hydraulic pumps as is well known to those skilled in the art. The backhoe is equipped with many valves (not shown) for controlling the position of the bucket, i.e., to tilt the bucket, swing the bucket, etc. as is well known to those skilled in the art. The disk 2 is rotated by a hydraulic motor/transmission 9 controlled by a valve (not shown) which supplies hydraulic fluid to hydraulic hoses 6 and 7.

The separator disclosed herein can adjust for material discharge size by adjusting the gap 3 between the cutout portion of the bucket 1 and the disk 2. This gap is determined by the cylinder 11 shown in FIGS. 4 and 5, cylinder 11 being controlled by another hydraulic valve (not shown) on the tractor TR. The cross frame 8 is movably attached to the bucket 1 by four hinges 10 as previously described, and as the hinges 10 (and frame assembly 8) are swung by the hydraulic cylinder 11, the gap 3 between the disk 2 and the bucket 1 may be adjusted between its minimum distance (FIG. 4) and its maximum distance (FIG. 5). In this manner, the gap 3 may be adjusted from, e.g., about one-half inch to about twelve inches. In actual practice, the gap 3 can be adjusted to zero, i.e., to completely cover the cutout portion of bucket 1 without a gap therebetween.

In operation, a first preferred size of particle to be separated is selected and the gap 3 between the disk 2 and the bucket 1 is adjusted accordingly by the hydraulic cylinder 11. The bucket 1 is then loaded by tilting and crowding the bucket 1 (as shown in FIG. 2A) thereby loading an aggregate mixture into the bucket 1. The hydraulic motor/transmission 9 rotates the disk 2 thereby agitating the aggregate mixture such that the particles smaller than the selected gap 3 size e.g., one inch in diameter, are thrown through the gap 3 and onto the ground by gravity and centrifugal force. The bucket 1 may be tilted so as to feed the rotating disk 2 until all the smaller particles are thrown out. The remaining larger particles may then be dumped out in another pile and the bucket 1 reloaded with another batch of aggregate, whereupon the process may be repeated. Alternatively, after ejecting all of the smaller size particles, the gap 3 may be increased and the process repeated until all of the aggregate material in the bucket 1 has been ejected in separate piles as desired.

In the above description, a preferred embodiment incorporates the invention into a backhoe as shown. It will be appreciated that the invention may be used in a fixed or permanent configuration; that is, the tractor TR may be eliminated and the stick S (or its equivalent) may be fixedly attached to e.g., an overhead beam. The bucket, instead of being self-loading, may then be filled by other means such as a dump truck, backhoe, etc. In this embodiment, a much larger bucket may be utilized for handling much larger loads. The overhead beam may include means for moving the bucket along the beam, much like an overhead crane, so as to enable the forming of a plurality of piles of different size particles. Alternatively, the piles may be accumulated on a movable conveyor belt.

What is claimed is:

1. Apparatus for separating aggregate material into separate piles according to size comprising:

a bucket adapted for holding a load of selected aggregate material, said bucket having an open portion in its bottom through which said aggregate may flow;

a disk, movably positioned adjacent to said open portion of said bucket and situated with respect to said open portion so as to partially block the flow of said aggregate material through said open portion;

means for moving said disk relative to said open portion of said bucket in a spaced-apart relationship, thereby forming a space between the periphery of said disk and the periphery of said open portion of said bucket; and, means for rotating said disk relative to said bucket while maintaining said space between said disk and said bucket.

2. The apparatus of claim 1 wherein said bucket is part of a backhoe.

3. The apparatus of claim 2 further including:

means for raising and lowering said bucket.

4. The apparatus of claim 3 further including:

means for tilting said bucket.

5. The apparatus of claim 2 further including:

means for vibrating said bucket.

6. The apparatus of claim 1 further including:

means for raising and lowering said bucket.

7. The apparatus of claim 6 further including:

means for tilting said bucket.

8. The apparatus of claim 1 further including:

means for vibrating said bucket.

9. The apparatus of claim 1 wherein said bucket is attached to an overhead crane.

* * * * *